US009592685B2

(12) United States Patent
Rigio et al.

(10) Patent No.: US 9,592,685 B2
(45) Date of Patent: Mar. 14, 2017

(54) SCANNING INKJET PRINTING SYSTEM

(71) Applicant: OCE-TECHNOLOGIES B.V., Venlo (NL)

(72) Inventors: Brandon Rigio, Venlo (NL); Brian D. Otter, Venlo (NL); Ryan C. Bryde, Venlo (NL); Michael P. Hoy, Venlo (NL); Chad A. Koehn, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/164,553

(22) Filed: May 25, 2016

(65) Prior Publication Data

US 2016/0263922 A1 Sep. 15, 2016

Related U.S. Application Data

(63) Continuation of application No. PCT/EP2014/076334, filed on Dec. 3, 2014.
(Continued)

(30) Foreign Application Priority Data

Jan. 29, 2014 (EP) ..... 14153005

(51) Int. Cl.
*B41J 25/00* (2006.01)
*B41J 19/00* (2006.01)
(Continued)

(52) U.S. Cl.
CPC ..... *B41J 25/001* (2013.01); *B41J 2/01* (2013.01); *B41J 19/00* (2013.01); *B41J 19/142* (2013.01); *B41J 19/20* (2013.01)

(58) Field of Classification Search
CPC ... B41J 25/001; B41J 2/01; B41J 19/20; B41J 19/00; B41J 19/142
See application file for complete search history.

(56) References Cited

U.S. PATENT DOCUMENTS 5,065,169 A 11/1991 Vincent et al.
5,828,501 A 10/1998 Menard et al.
(Continued)

FOREIGN PATENT DOCUMENTS

DE 197 28 232 A1 1/1998
EP 2 000 316 A1 12/2008
WO WO 2006/116574 A2 11/2006

OTHER PUBLICATIONS

"Metal Gantry Beam with Glass Running Surface", Research Disclosure, RD582090, Oct. 1, 2012, 2 pages.

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

An inkjet printing apparatus includes an inkjet print head arranged to be moveable in a direction of movement along a guiding assembly. The guiding assembly includes a support structure; a strip mounted on the support structure, the strip being substantially rigid and straight in a first direction substantially perpendicular to the direction of movement and mounted in such way that a straightness in the direction of movement is provided; and an air bearing system operatively coupled to the strip. The strip extends in a vertical plane, the vertical plane being substantially parallel to the direction of movement and being substantially parallel to the first direction. The air bearing system is configured to control a position of the inkjet print head in a horizontal plane relative to the strip during movement of the print head in the direction of movement, the horizontal plane being substantially perpendicular to the vertical plane. Employing such a strip and a suitable mounting method for mounting the strip on the support structure, it is enabled to select a cost-effective and/or light-weight support structure.

6 Claims, 6 Drawing Sheets

Related U.S. Application Data

(60) Provisional application No. 61/912,817, filed on Dec. 6, 2013.

(51) Int. Cl.

| | |
|---|---|
| ***B41J 19/14*** | (2006.01) |
| ***B41J 19/20*** | (2006.01) |
| ***B41J 2/01*** | (2006.01) |

(56) References Cited

U.S. PATENT DOCUMENTS

| | | | |
|---|---|---|---|
| 2007/0153071 | A1 | 7/2007 | Chung et al. |
| 2008/0309715 | A1 | 12/2008 | Shamoun et al. |
| 2009/0001243 | A1 | 1/2009 | Weingartner |
| 2010/0309263 | A1 | 12/2010 | Huang |
| 2011/0148985 | A1 | 6/2011 | Albertalli et al. |
| 2011/0181659 | A1 | 7/2011 | Fukunaga |
| 2012/0262527 | A1 | 10/2012 | Mills et al. |

SCANNING INKJET PRINTING SYSTEM

CROSS REFERENCE TO RELATED APPLICATIONS

This application is a Continuation of PCT International Application No. PCT/EP2014/076334, filed on Dec. 3, 2014, which claims priority under 35 U.S.C. 119(e) to U.S. Provisional Application No. 61/912,817, filed on Dec. 6, 2013 and under 35 U.S.C. 119(a) to patent application Ser. No. 14/153,005.5, filed in Europe on Jan. 29, 2014, all of which are hereby expressly incorporated by reference into the present application.

FIELD OF THE INVENTION

The present invention generally pertains to an inkjet printing apparatus having an inkjet print head arranged on a carriage moveable in a scanning direction.

BACKGROUND ART

An inkjet printing apparatus having an inkjet print head arranged on a moveable carriage is well known in the art. The carriage is configured to reciprocate in a scanning direction. While the carriage moves, the inkjet print head ejects droplets of ink to form a swath of image dots on a recording medium. After one or multiple passes of the carriage, depending on a print strategy, the carriage and the recording medium are moved relative to each other, i.e. the recording medium may be moved or the carriage may be moved, in a transport direction, which is substantially perpendicular to the scanning direction. A next swath may then be printed. The next swath may be adjacent to the earlier swath or may be (partly) overlapping, depending on the print strategy, as is also well known in the art.

The image dots have commonly a diameter of about 40 micron or smaller, which corresponds to an image resolution of about 600 dots per inch (dpi), or higher. In order to obtain a high image quality, the positioning of the dots should be considerably better than their diameter. So, the position of each dot should be accurate and may only deviate about 10 micron or less, in particular relative to each other. To position the image dots of a second swath accurately compared to the image dots of a first swath, the movement of the carriage should be accurate and reproducible. In the prior art, many solutions to accurately control a movement and position of the carriage relative to the recording medium are available. However, the need for high speed printing requires higher carriage speeds, while even more print heads are arranged on the carriage, thereby increasing the weight of the carriage. From a mechanical and control perspective, increasing weight and speed while maintaining accurate positioning puts high demand on the mechanical construction.

On the other hand, there is a need to reduce costs, such as the manufacturing costs, of the inkjet printing apparatus. Thus, it is desired to and it is an object of the present invention to provide for a low cost mechanical construction that is suited to allow for high speed printing.

SUMMARY OF THE INVENTION

In an aspect of the present invention, an inkjet printing apparatus according to claim 1 is provided.

In the inkjet apparatus according to the present invention, a strip is employed to provide for a straight element guiding the movement of a print head in a direction of movement. A light-weight and/or cost-effective support structure may be provided, since the support structure does not need to provide for the straightness, but only for a suitable support for the strip. Applying a suitable mounting method, the straightness of the strip in the direction of movement is provided and maintained irrespective of the straightness of the support structure.

To control a print head position in a horizontal plane, the strip is arranged in a vertical plane and parallel to the direction of movement. In a first direction, the strip is substantially rigid and straight, the first direction being substantially perpendicular to the direction of movement. Hence, the straightness in the direction of movement is provided by suitable mounting on the support structure and a straightness in the vertical plane, which corresponds to the above-mentioned first direction, perpendicular to the direction of movement is provided by the strip, wherein the straightness of the strip in the first direction is maintained after mounting due to its rigidness in the first direction. The straightness and rigidness in the first direction (i.e. in the vertical plane) should be sufficient to provide a well-defined reference surface for an air bearing system as applied in the inkjet printing apparatus according to the present invention as described and elucidated hereinbelow.

In an embodiment, the direction of movement may be a scanning direction if the guiding assembly comprises a carriage supporting the print head and configured to move the print head in the scanning direction, i.e. a direction for applying a swath of ink dots.

In an embodiment, the direction of movement may be a transport direction if the guiding assembly comprises a gantry supporting a carriage, the carriage supporting the print head. Such gantry is configured to move the carriage and supported print head in the transport direction, i.e. a direction perpendicular to the scanning direction.

An air bearing system is used to position the print head relative to the strip. The air bearing system is operatively coupled to the print head. While the print head is being moved parallel to and along the strip, the air bearing system maintains a predetermined distance from the strip, thereby ensuring that a trajectory of the print head corresponds to the shape of the strip in the direction of movement. As the strip is maintained straight, the trajectory of the print head is straight.

The print head may be arranged on a carriage, which carriage is arranged and configured to move in the scanning direction such that the print head is enabled to provide a swath of image dots on the recording medium. The trajectory of the carriage determines the trajectory of the print head. In an embodiment, the air bearing system is operatively coupled to the carriage such that the shape of the strip determines the trajectory of the carriage.

In an embodiment, the print head is operatively coupled to a gantry, which gantry is arranged and configured to transport the print head to a position corresponding to a subsequent swath of image dots. Thus, the gantry is configured to move the print head in a transport direction, the transport direction being substantially perpendicular to the scanning direction. The accuracy of the movement in the transport direction determines the accuracy of the relative positioning of swaths, in particular adjacent swaths. In this embodiment, the air bearing system is operatively coupled to the gantry such that the trajectory of the gantry is determined by the shape of the strip in the direction of movement.

A very suitable and cost-effective material for the strip is glass or a glass-like material, i.e. a material having similar physical properties with respect to rigidness and straightness and suitability for use in combination with an air bearing system. Glass is manufactured at a low cost and commonly flat and straight. A suitable strip of glass is therefore easily and cost-effectively manufactureable. Glass or a glass-like material is also very suitable for use in combination with an air bearing. Selecting a thickness of the glass enables to select a suitable rigidness of the glass in at least the first direction. A suitable adhesive may be used to mount the glass strip to the support structure, such as a support structure made of sheet metal. Selecting an adhesive having a suitable flexibility ensures that the glass strip does not bend or otherwise change it shape due to any stress in or bending of the support structure. However, other suitable mounting methods may be suitably applied as well.

In an embodiment, the strip is mounted to a mounting surface of the support structure and the strip extends beyond an end of the mounting surface of the support structure such that a first surface of the strip and a second surface of the strip, which second surface is opposite to the first surface, are uncovered. The first and the second surface extend in the vertical plane and the air bearing system comprises a first air bearing unit operatively coupled to the uncovered first surface and a second air bearing unit is operatively coupled to the uncovered second surface.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
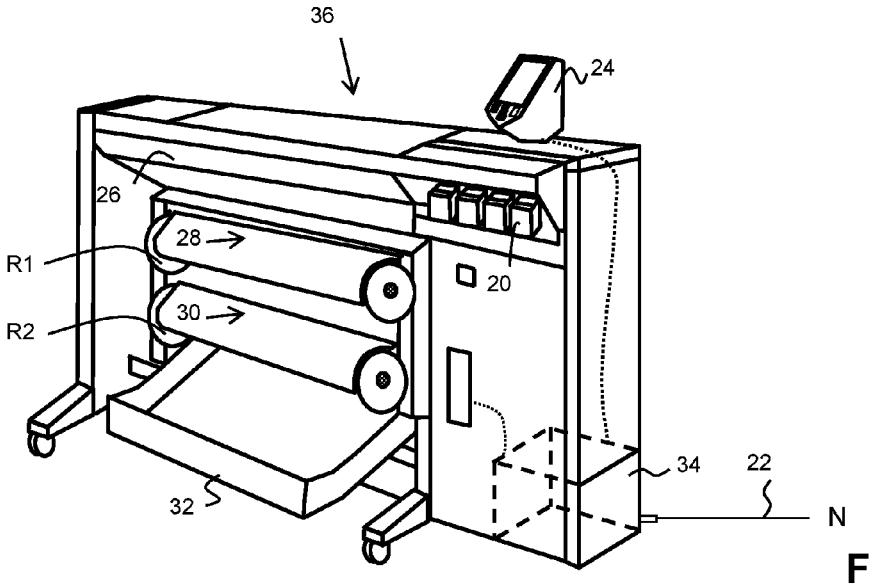
FIG. 1A is a perspective view on an exemplary large format inkjet printing apparatus.

The present invention will now be described with reference to the accompanying drawings, wherein the same reference numerals have been used to identify the same or similar elements throughout the several views.

Figure 1B:
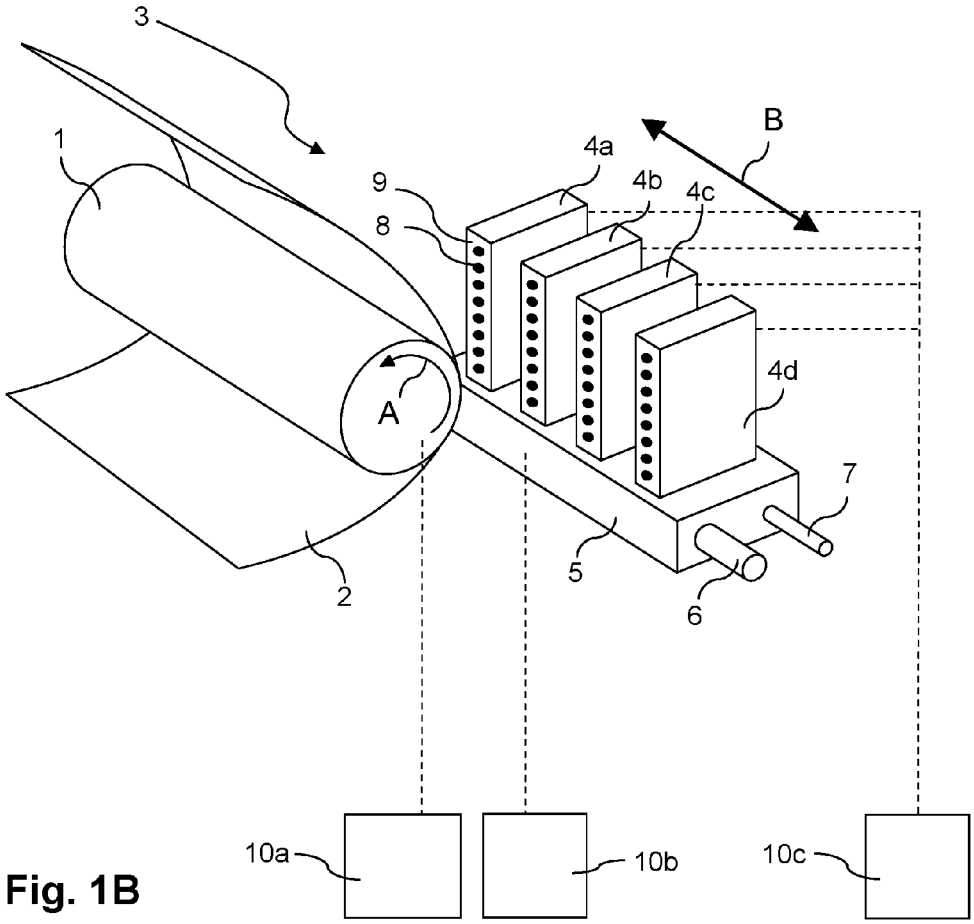
FIG. 1B is a schematic representation of a scanning inkjet system.

FIG. 1A shows an inkjet printing apparatus 36, wherein printing is achieved using a wide format inkjet printer. The wide-format inkjet printing apparatus 36 comprises a housing 26, wherein the printing assembly, for example the ink jet printing assembly shown in FIG. 1B is arranged. The inkjet printing apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format inkjet printing apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The inkjet printing apparatus 36 may optionally be connected to a network N. The connection to the network N is diagrammatically shown in the form of a cable 22, but nevertheless, the connection could be wireless. The inkjet printing apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print head carriage 5. The scanning print head carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material. The scanning print head carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print head carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print head carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material. The print head carriage 5 is guided by guiding means 6, 7. These guiding means 6, 7 may be rods as depicted in FIG. 1B. The rods may be driven by suitable driving means (not shown). Alternatively, the print head carriage 5 may be guided by other guiding means, such as an arm being able to move the print head carriage 5. Another alternative is to move the image receiving material 2 in the main scanning direction B. Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 1C:
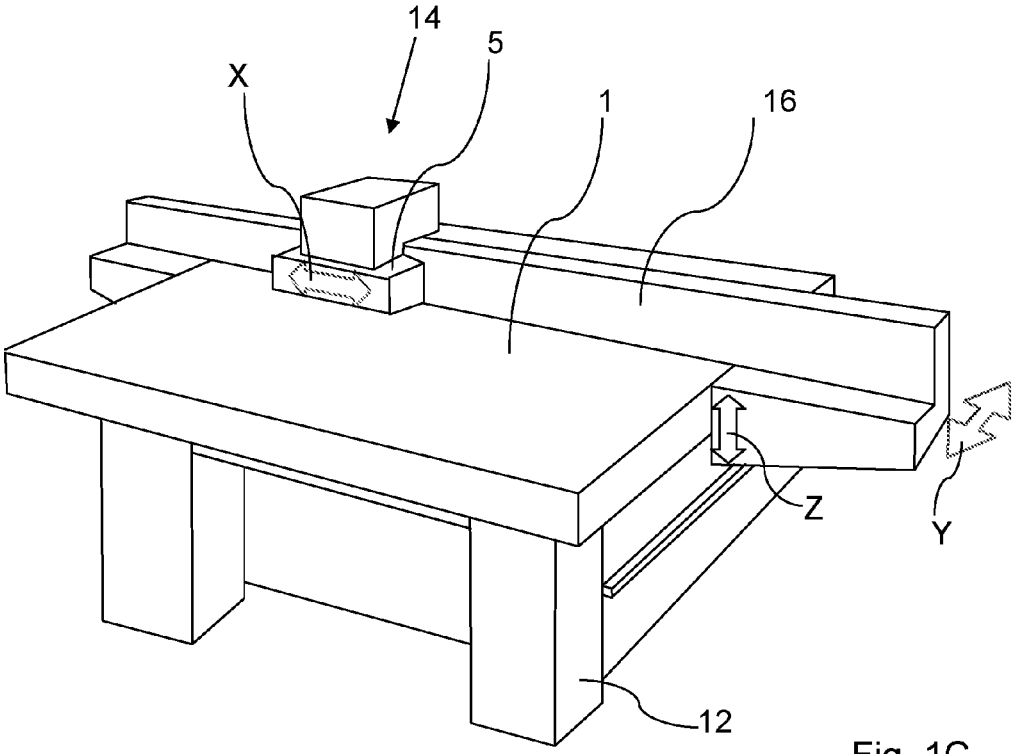
FIG. 1C is a perspective view of another exemplary large format inkjet printing apparatus.

FIG. 1C shows another embodiment of an inkjet printing apparatus 14 (herein also referred to as a printing apparatus), in which the medium supporting means 1 is a flat surface. On the flat surface a non-flexible flat medium may be arranged and may be printed on. The medium supporting means 1 is supported on a suitable base structure 12 and a carriage guiding assembly 16 is arranged over the medium supporting means 1. Such carriage guiding assembly 16 is also known in the art as a gantry. The carriage guiding assembly supports the print head carriage 5 such that the print head carriage 5 is enabled to scan in an X-direction. The carriage guiding assembly 16 is arranged and configured to be enabled to reciprocate in a Y-direction, wherein the Y-direction is usually substantially perpendicular to the X-direction. In a known printing apparatus 14, the carriage guiding assembly 16 is also arranged and configured to be enabled to move in a Z-direction, which is substantially perpendicular to the X-direction and the Y-direction such to enable to adapt the printing apparatus 14 to a thickness of the recording medium being arranged on the medium supporting surface 1.

In particular, the accuracy of the movement and positioning in the X and Y directions is relevant to an image quality resulting from a printing operation. In order to accurately position the droplets on the recording medium, it is desired that the movement in the X and in the Y direction is as straight as possible. However, in order to reduce costs and allow for high accelerations without introducing disturbing vibrations, it is desired to employ cost-effective and light-weight materials.

Figure 2A:
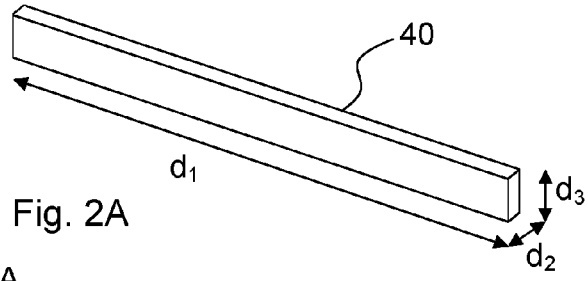
FIG. 2A is a perspective view of an exemplary strip for use with the present invention.

FIG. 2A illustrates a strip 40 that may be employed in accordance with the present invention for guiding a movement. The strip has a length $d_1$, a width $d_2$ and a height $d_3$. The strip 40 is to be mounted such that a guided element moves along the length $d_1$ of the strip 40. Therefore, as is elucidated hereinafter in more detail, the strip 40 is to be mounted such that straightness in the direction of the length $d_1$ is obtained and maintained.

The material properties of the strip 40 need to be such that the strip 40 is rigid in at least the height $d_3$ in order to be suitable for guiding. In the direction of the length $d_1$ rigidity may be provided by the strip material properties or may be provided by a suitable mounting on the support structure. In the latter embodiment, the support structure and the properties of the mounting method applied need to be selected and their properties need to be taken into account when designing the guiding assembly. In particular, the mounting of the strip on the support structure needs to ensure the straightness and needs to maintain such straightness over time. In the first embodiment, i.e. the rigidity in the direction of the length $d_1$ is provided by the strip material, the straightness needs to be provided by the strip material and such straightness needs to be maintained over time by a suitable mounting, which mounting prevents mechanical stresses upon changing conditions such as temperature, moist, and the like. So, in either embodiment, a suitable mounting is required. Further, irrespective of whether the straightness is provided by the strip material or by the mounting in combination with the strip material, the support structure does not need to provide for accurate straightness and is therefore suitable to be constructed by cost-effective materials and methods and/or light-weight materials and construction.

Figure 2B:
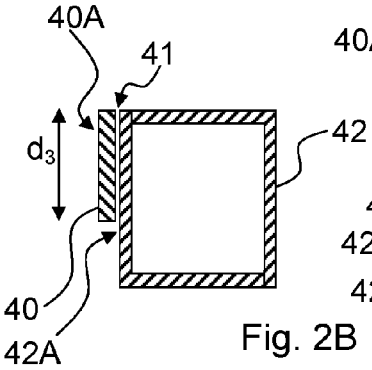
FIG. 2B-2D show cross-sections of a first, second and third embodiment, respectively, of a support structure and strip mounted thereon in accordance with the present invention.
Figure 2C:
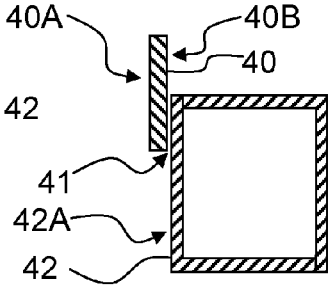
Figure 2D:
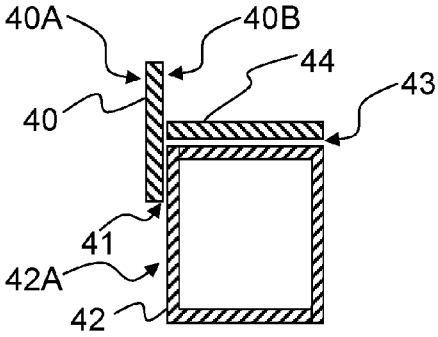

Particular embodiments of an assembly of the strip 40 and an exemplary support structure are illustrated in FIGS. 2B-2D. In a first embodiment, illustrated in FIG. 2A, the strip 40 is mounted on a support beam 42. A first guiding surface 40A is exposed, while an opposite surface is facing a mounting surface 42A of the support beam 42. The strip 40 may be mounted by application of a suitable adhesive. Presuming that the support beam 42 is not accurately straight, any local distance variations between the support beam 42 and the strip 40 may be filled with the adhesive. The strip 40 may as well be mounted by application of two or more mounting screws (or bolts) provided through the strip 40, wherein the holes through which such screws extend allow the strip 40 to move and wherein it is ensured that the mounting does not influence the straightness of the strip 40. It is noted that in a mounting embodiment employing screws or bolts, it is preferred that the strip 40 provides for rigidity and straightness in the direction of the length $d_1$, while use of an adhesive may require more care and attention during mounting.

In a second embodiment, illustrated in FIG. 2B, the strip is mounted to a mounting surface 42A of the support beam 42 and the strip 40 extends beyond an end of the mounting surface 42A such that a first guiding surface 40A and a second guiding surface 40B are uncovered. The second guiding surface 40B is opposite to the first guiding surface 40A and both extend in a vertically arranged plane. Mounting of the strip 40 on the support beam 42 may be performed similarly to the exemplary methods described above in relation to the first embodiment, illustrated in FIG. 2B.

In a third embodiment, illustrated in FIG. 2D, a further guiding surface is provided by a further strip 44, providing for a smooth and flat running surface, e.g. by mounting the further strip 44 on the support beam 42 by use of a suitable adhesive filling any local variations in a gap distance of a gap 43 between the strip 44 and the support beam 42.

It may be clear to one skilled in the art that such further strip 44 may as well be employed in and combined with the first embodiment illustrated in FIG. 2B. An exemplary embodiment of such further strip 44, including a material selection and a mounting method, is known from the prior art as described in Research Disclosure, RD582090, Oct. 1, 2012, which is incorporated herein by reference.

Figure 3A:
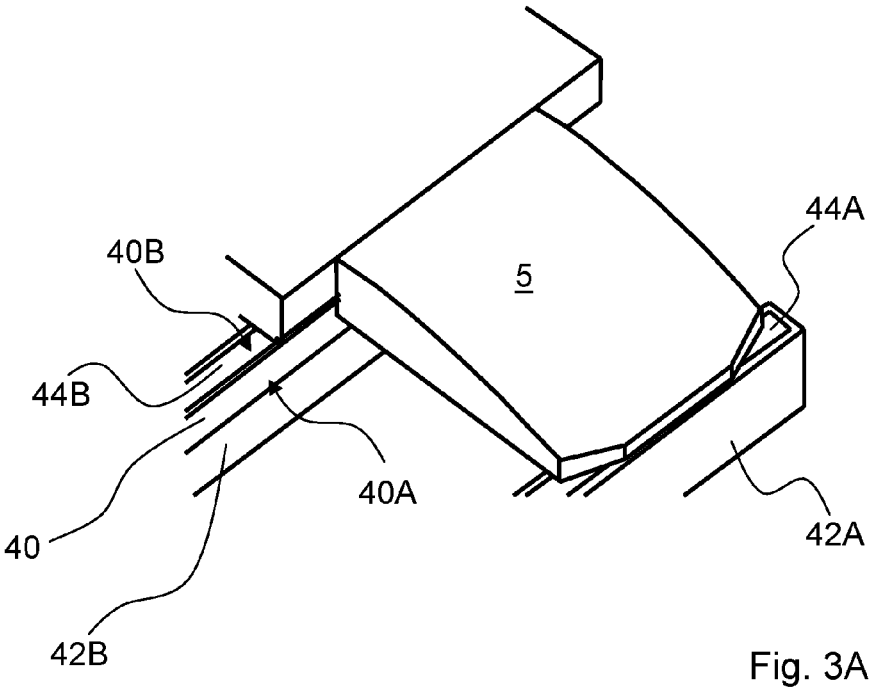
FIG. 3A-3B show a perspective view on a print head carriage as used in an embodiment of a inkjet printing apparatus according to the present invention.
Figure 3B:
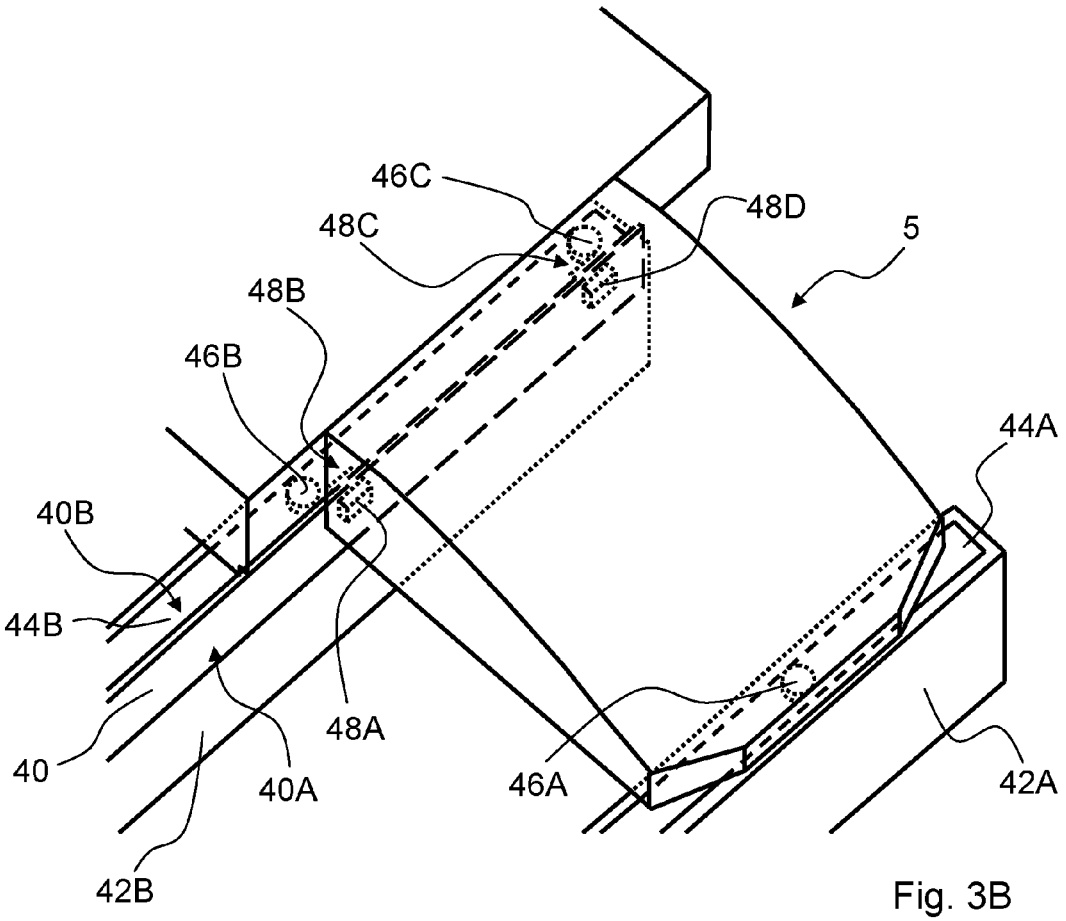

FIGS. 3A and 3B illustrate a practical embodiment of an inkjet print head carriage 5 supported and guided in accordance with the present invention. The carriage 5 is supported on a first support beam 42A and a second support beam 42B. The first support beam 42A is provided with a smooth and flat guiding surface provided by a first horizontally arranged strip 44A. The second support beam 42B is provided with a vertically arranged strip 40 and a second horizontally arranged strip 44B. Please note that the configuration of the second support beam 42B and strips 40 and 44B is similar to the configuration illustrated in FIG. 2D. In particular, the strip 40 extends in a vertical direction beyond the second horizontally arranged strip 44B.

The carriage 5 is provided with a first supporting air bearing unit 46A operatively coupled to the first horizontally arranged strip 44A and with a second supporting air bearing unit 46B and a third supporting air bearing unit 46C, each operatively coupled to the second horizontally arranged strip 44B. The first, second and third supporting air bearing units 46A, 46B, 46C support the weight of the carriage 5 and provided for low friction allowing the carriage 5 to smoothly move in the direction in which the support beams 42A and 42B extend.

The carriage 5 is further provided with a first guiding air bearing unit 48A, a second guiding air bearing unit 48B, a third guiding air bearing unit 48C and a fourth guiding air bearing unit 48D. The first and the fourth guiding air bearing units 48A and 48D are operatively coupled to the first guiding surface 40A of the strip 40. The second and the third guiding air bearing units 48B and 48C are operatively coupled to the second guiding surface 40B of the strip 40. Although not strictly necessary, the first guiding air bearing unit 48A and the second guiding air bearing unit 48B are arranged opposite to each other and the third guiding air bearing unit 48C and the fourth guiding air bearing unit 48D are arranged opposite to each other, the strip 40 extending and arranged between each of the two opposing pairs of guiding air bearing units. Thus, a straight and low friction guiding assembly is provided, enabling a cost-effective and/or low weight support assembly, including but not limited to the support beams 42A and 42B.

Figure 4A:
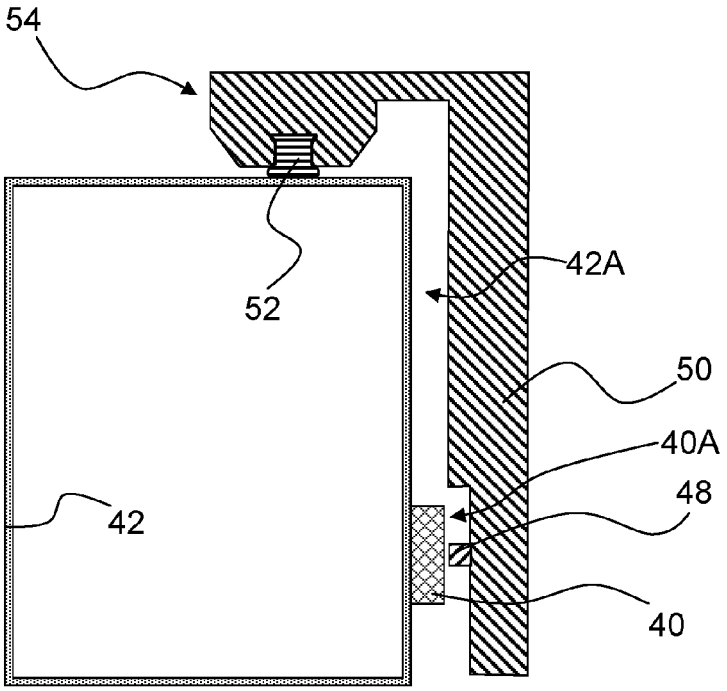
FIG. 4A shows a cross-section of a first embodiment of a guiding assembly in accordance with the present invention.
Figure 4B:
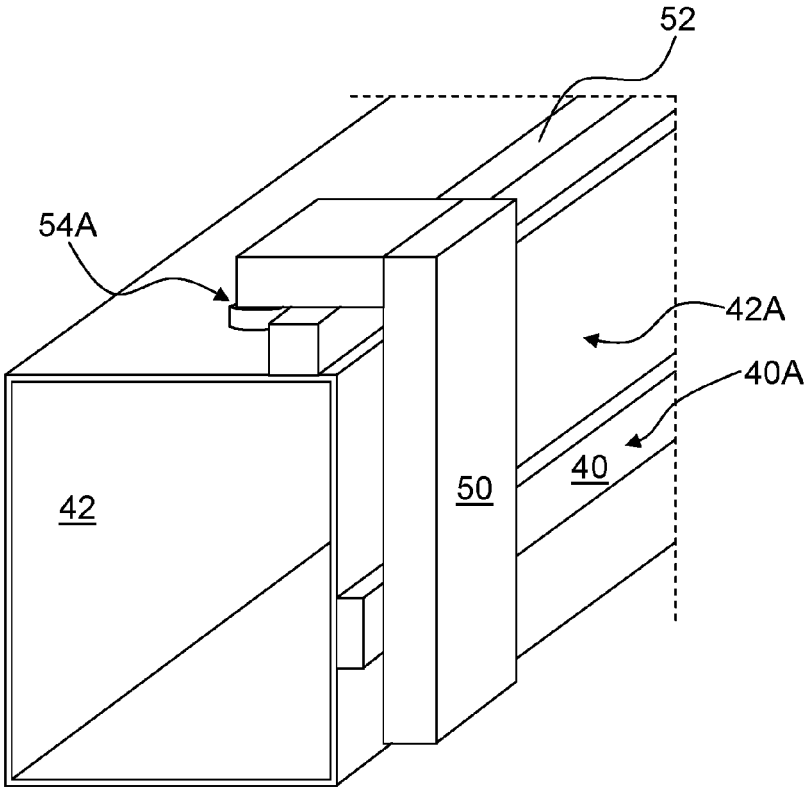
FIG. 4B is a perspective view of a second guiding assembly in accordance with the present invention.

FIG. 4A and FIG. 4B each illustrate a single beam embodiment of a carriage guiding assembly in accordance with the present invention. In each embodiment, a support beam 42 is provided with a strip 40 on a mounting surface 42A, thereby providing a guiding surface 40A. A carriage support frame 50 is arranged such that an air bearing unit 48 is operatively coupled to the guiding surface 40A. The air bearing unit 48 maintains a predetermined distance between the air bearing unit 48 and the guiding surface 40A, thereby providing that a position of a carriage (not shown in FIGS. 4A and 4B) mounted on the carriage support frame is defined by a position of the guiding surface 40A.

In the embodiment of FIG. 4A, the carriage support frame 50 is supported by a guiding rail 52 mounted on top of the support beam 42. A shape of a cross-section of the guiding rail 52 in cooperation with a guiding rail mating structure 54 keeps the carriage support frame 50 in position, including supporting the weight of the carriage support frame and possibly even the weight of the carriage, although in an embodiment, the weight of the carriage may be supported by separate means.

In the embodiment of FIG. 4B, a straight guiding rail 52 is employed and a roller 54A is operatively coupled to keep the carriage support frame 50 in position. The straight guiding rail 52 may be provided with an encoder strip for controlling the movement of the carriage support frame 50. To prevent high friction forces between the carriage support frame 50 and a top surface of the guiding rail 52, suitable friction lowering means may be employed. For example, an air bearing may be provided to provide and maintain a gap between the top surface of the guiding rail 52 and the carriage support frame 50.

In the embodiments illustrated in FIGS. 4A and 4B, the positioning of the guiding rail 52 relative to the guiding surface 40A of the strip 40 is preferably as accurate as possible in order to prevent errors in misalignment in droplet positioning due to variations in angle and position of the print head depending on the position along the guiding rail 52. Thereto, in an embodiment, a support structure, constructed as a sheet-metal beam, is constructed such to have at least one substantially flat surface, on which the guiding rail 52 is to be mounted and the guiding rail 52 is mounted relative to the guiding surface 40A using a method in which a position of the guiding surface 40A is replicated in the position of the guiding rail 52.

Figure 5A:
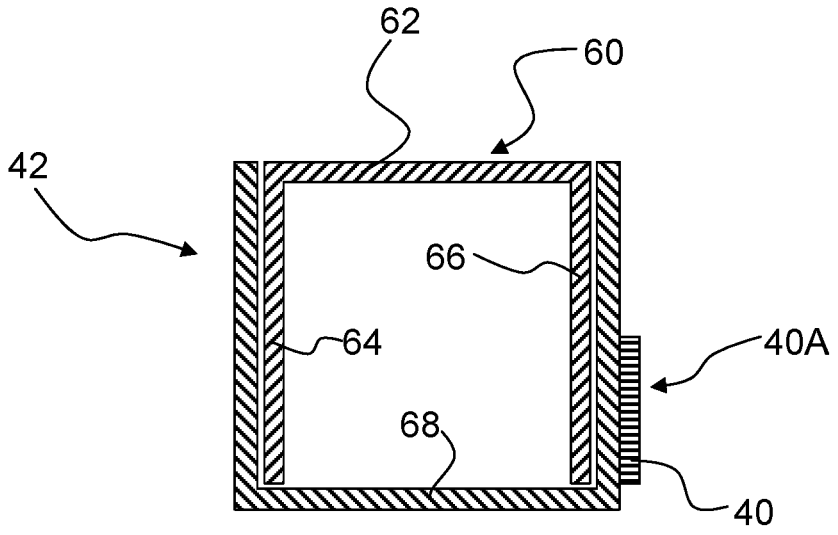
FIG. 5A shows a cross-section of an exemplary support beam for use in the present invention.
Figure 5B:
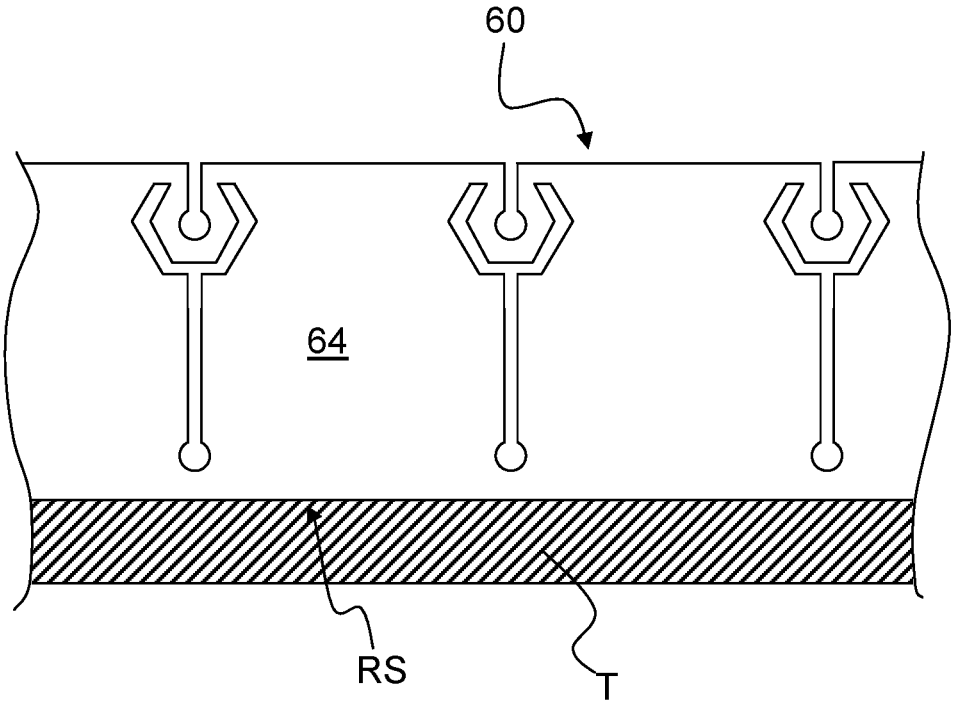
FIG. 5B shows a side view of an exemplary beam element for use in a support beam shown in FIG. 5A.

As an exemplary embodiment, FIGS. 5A and 5B show a U-shaped first beam element 60. The first beam element 60 has a rail mounting surface 62 and has two flanges 64 and 66, each flange 64, 66 substantially perpendicularly arranged relative to the rail mounting surface 62. Each flange 64, 66 is segmented by slits 65 provided therein, allowing the rail mounting surface 62 to be bent slightly. In order to provide a substantially flat rail mounting surface 62, the first beam element 60 may be arranged on a defined reference surface RS, e.g. a surface of a granite table T. The rail mounting surface 62 is positioned on the reference surface RS and the rail mounting surface 62 is clamped to the reference surface RS such that a flatness of the reference surface RS is replicated in the rail mounting surface 62.

Then, as illustrated in FIG. 5A, a U-shaped second beam element 68 may be provided for structural stiffness and fixating the shape of the rail mounting surface 62. Thereto, the second beam element 68 is arranged to be bolted (or otherwise mounted) to the first beam element 60 such that the mutual positions of the segments of the flanges 64, 66 become fixated, thereby preventing the rail mounting surface 62 to flex back into its original shape.

Of course, it should be noted that the illustrated embodiment is merely exemplary for the method and its resulting support structure. In practice, the method may include more steps employing more and/or other elements. In essence, the method entails that the bendable rail guiding surface 62 is fixated in a straight and flat shape replicated from a predefined reference surface RS.

Having constructed a support beam 42 with at least one substantially flat surface by using the above-described method or any other suitable method, the strip 40 may be provided on one of the side surfaces, i.e. the surfaces perpendicular to the rail guiding surface 62. The strip 40 is provided and mounted such that the guiding surface 40A is substantially straight in accordance with the present invention.

Figure 6:
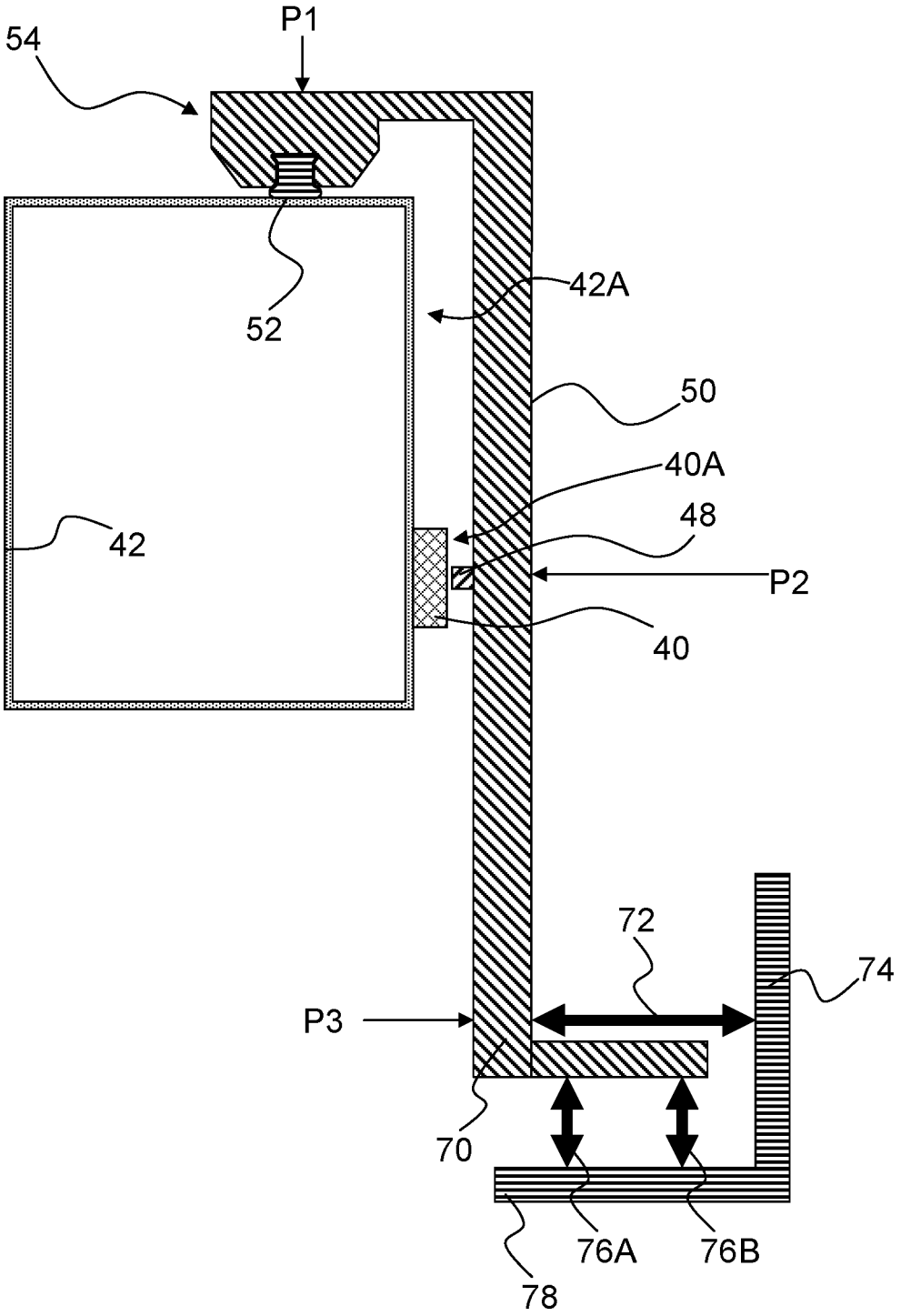
FIG. 6 shows a cross-section of a support beam and carriage support frame for illustrating a method for positioning a guide rail.

FIG. 6 illustrates an exemplary method for positioning the guiding rail 52 on the substantially flat rail mounting surface 62 by replicating a relative position of the guiding surface 40A of the strip 40.

Presuming that an air bearing position P2 defines a horizontal position of the print heads that may be arranged on a carriage which is to be mounted on the carriage support frame 50, a mating structure position P1 determines an angle of the print heads which in effect determines a direction in which droplets may be ejected from the print heads.

Ensuring that a horizontal distance between the mating structure position P1 and the air bearing position P2 is constant along the guide rail 52 and the strip 40 ensures that the droplet ejection angle is constant along the guide rail 52 and the strip 40. Therefore, it is preferred to replicate the straightness of the guide surface 40A in the guide rail 52.

In this embodiment of the rail mounting method, an extended carriage support frame 50' is employed for the purpose of replicating the position of the guide surface 40A. Due to the shape and stiffness of the extended carriage support frame 50', the mating structure position P1 and the air bearing position P2 define an end position P3, being the position of an end portion 70 of the extended carriage support frame 50'.

At the end position P3, in a first embodiment, a distance control element 72 is arranged in order to maintain, define or measure (depending on the embodiment, which may be suitably selected by any person skilled in the art) a distance between the end portion 70 of the extended carriage support frame 50' and a straight reference surface 74. The position of the extended carriage support frame 50' may now be determined at the end position P3 by the straight reference surface 74 and at the air bearing position P2 by the straight guide surface 40A of the strip 40. The mating structure position P1, i.e. the desired position of the guide rail 52, results therefrom. Based on the resulting mating structure position P1, the position of the guide rail 52 can be fixated by suitably mounting the guide rail 52. Having mounted the guide rail 52 at the desired mating structure position P1 as replicated from the guide surface 40A, the extended carriage support frame 50' may be replaced by the carriage support frame 50 for normal use. In a second embodiment, in order to control the roll of the carriage support frame 50 even more accurately, a substantially horizontally arranged element may be provided as a part of the end portion 70. Using a horizontally arranged reference surface 78 and two distance control elements 76A, 76B, an angle between the horizontal part of the end portion 70 and the horizontal reference surface 78 may be determined by comparison of such two distances. Aiming at arranging a nozzle surface of a print head parallel to a print surface, the horizontal part of the end portion 70 is to be configured to be parallel to the horizontal reference surface 78, which is directly controlled in this second embodiment. Please note that the first and the second embodiment may be combined, although in such combined embodiment, it may be needed to have more adjustment functionality should be provided, for example for adjusting a distance from the guide surface 40A, e.g. by adjustment of an air pressure exerted by the air bearing unit 48 at the air bearing position P2. Thereby, in such combined embodiment, it may be enabled to not only adjust a vertical position and/or a roll but also adjust a horizontal position, for example.

Thus, a simple, cost-effective and/or light weight beam having only one substantially flat surface can be employed to provide for a guiding assembly that is suitably straight in two surfaces for controlling the roll resulting from any difference between a guide path provided by the strip 40 and a guide path provided by the guide rail 52. Controlling the roll in this way provides for improved droplet placement accuracy and consequently for improved image quality. Further, it is noted that the assembly of a guide rail and a guide surface guiding and supporting a frame is not necessarily limited to the use of a strip as used in the present invention. Any support structure providing the two straight guiding elements (i.e. rail and surface) having an accurate position relative to each other may be used as well to control the roll accordingly.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet printing apparatus comprising:

an inkjet print head arranged to be moveable in a direction of movement along a guiding assembly, the guiding assembly comprising:

a support structure having a support surface extending in a horizontal plane and a mounting surface in a vertical plane, the vertical plane being substantially perpendicular to the horizontal plane;

a strip mounted on the mounting surface of the support structure and providing a guiding surface, the strip being substantially rigid and straight in a first direction substantially perpendicular to the direction of movement and mounted in such way that a straightness in the direction of movement is provided; and an air bearing system operatively coupled to the strip, wherein the strip extends in a vertical plane, the vertical plane being substantially perpendicular to the direction of movement and being substantially parallel to the first direction, wherein the print head is supported on the support surface, and wherein the air bearing system is configured to control a position of the inkjet print head within a horizontal plane by guiding movement of the print head in the direction of movement along the guiding surface provided by the strip.

2. The inkjet printing apparatus according to claim 1, wherein the strip is made of glass.

3. Inkjet printing apparatus according to claim 1, wherein the guiding assembly comprises a carriage, and wherein the print head is arranged on the carriage and the carriage is arranged to move along the guiding surface of the support structure in the direction of movement, the direction of movement being a scanning direction.

4. The inkjet printing apparatus according to claim 1, wherein the guiding assembly comprises a gantry, wherein the print head is arranged to move along the gantry in a scanning direction, and wherein the gantry is arranged to move along the guiding surface of the support structure in the direction of movement, the direction of movement being a transport direction, the transport direction being substantially perpendicular to the scanning direction.

5. The inkjet printing apparatus according to claim 1, wherein the strip extends beyond an end of the mounting surface of the support structure such that a first surface of the strip and a second surface of the strip are uncovered, the second surface being opposite to the first surface and both extending in the vertical plane, and wherein the air bearing system comprises a first air bearing unit operatively coupled to the uncovered first surface and a second air bearing unit operatively coupled to the uncovered second surface.

6. The inkjet printing system according to claim 1, wherein the strip is mounted to the support structure by an adhesive layer.

* * * * *